US010729171B2

(12) United States Patent
Penrose et al.

(10) Patent No.: US 10,729,171 B2
(45) Date of Patent: Aug. 4, 2020

(54) SMOKING ARTICLE FILTER AND INSERTABLE FILTER UNIT THEREFOR

(75) Inventors: Graham Penrose, Milton Keynes (GB); Michael Malthouse, Milton Keynes (GB); David Wake, Milton Keynes (GB); Gary Fulcher, Milton Keynes (GB); Michael Simpson, Sibuya-ku (JP); Aaron Brookbank, London (GB); Gordon Grierson, London (GB); Jon Hindley, London (GB); John Sampson, London (GB); Rabya Khan-Dar, London (GB); Karl Kaljura, London (GB); Lean Ho Ong, London (GB); John Richardson, London (GB); John Major, London (GB); Richard Young, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 1531 days.

(21) Appl. No.: 14/129,879

(22) PCT Filed: Jun. 27, 2012

(86) PCT No.: PCT/EP2012/062496

§ 371 (c)(1),
(2), (4) Date: Jul. 7, 2014

(87) PCT Pub. No.: WO2013/000967

PCT Pub. Date: Jan. 3, 2013

(65) Prior Publication Data

US 2014/0332014 A1 Nov. 13, 2014

(30) Foreign Application Priority Data

Jun. 27, 2011 (GB) ..... 1110863.6
May 28, 2012 (GB) ..... 1209426.4

(51) Int. Cl.
*A24D 3/04* (2006.01)
*A24D 3/06* (2006.01)
*A24D 3/14* (2006.01)

(52) U.S. Cl.
CPC ..... *A24D 3/04* (2013.01); *A24D 3/048* (2013.01); *A24D 3/061* (2013.01); *A24D 3/14* (2013.01)

(58) Field of Classification Search
None
See application file for complete search history.

(56) References Cited

U.S. PATENT DOCUMENTS 2,863,461 A * 12/1958 Frost, Jr. ..... A24D 3/061 131/337
3,508,558 A 4/1970 Seyburn
(Continued)

FOREIGN PATENT DOCUMENTS

CA 2056683 A1 5/1992
CA 2631413 A1 11/2009
(Continued)

OTHER PUBLICATIONS

Office Action dated Mar. 31, 2015 for JP Patent Application No. 2014-517688 (English machine translation), referencing JP 61-100180; JP 9-187266 and JP 4-121179 (copies attached).
(Continued)

*Primary Examiner* — Dennis R Cordray
(74) *Attorney, Agent, or Firm* — Cantor Colburn LLP

(57) ABSTRACT

A smoking article filter (20) comprises a recess (25) to receive a filter insert unit (30). The filter insert unit (30) is secured to the filter (20) once inserted. The filter (20) and the filter insert unit (30) may comprise additives such as flavourants, colourants or sorbents.

13 Claims, 13 Drawing Sheets

(56) References Cited

U.S. PATENT DOCUMENTS

| | | | | |
|---|---|---|---|---|
| 3,946,748 | A * | 3/1976 | Frankfurt | A24D 3/04 131/339 |
| 4,319,590 | A | 3/1982 | Patarra | |
| 4,355,995 | A | 10/1982 | Berger | |
| 4,718,438 | A * | 1/1988 | Deal | A24D 3/041 131/198.2 |
| 4,729,391 | A * | 3/1988 | Woods | A24D 3/061 131/332 |
| 4,809,718 | A | 3/1989 | Deal | |
| 4,856,540 | A * | 8/1989 | Jansma | A24D 1/045 131/189 |
| 4,887,617 | A | 12/1989 | Ruppert et al. | |
| 4,889,143 | A | 12/1989 | Pryor | |
| 4,889,144 | A | 12/1989 | Tateno | |
| 5,067,500 | A | 11/1991 | Keritsis | |
| 5,724,997 | A | 3/1998 | Smith et al. | |
| 6,854,469 | B1 * | 2/2005 | Hancock | A24C 5/005 131/60 |
| 7,243,659 | B1 | 7/2007 | Lecoultre et al. | |
| 2004/0261807 | A1 | 12/2004 | Dube | |
| 2005/0066982 | A1 | 3/2005 | Clark et al. | |
| 2005/0115578 | A1 | 6/2005 | Launstein et al. | |
| 2005/0126395 | A1 | 6/2005 | Blackburn | |
| 2008/0029112 | A1 * | 2/2008 | McHugh | A24D 3/0212 131/280 |
| 2009/0050168 | A1 | 2/2009 | Higgins | |
| 2009/0288667 | A1 | 11/2009 | Andresen et al. | |
| 2009/0288669 | A1 | 11/2009 | Hutchens | |
| 2010/0108085 | A1 | 5/2010 | Duke | |
| 2010/0163065 | A1 * | 7/2010 | Chang | A24F 7/02 131/338 |

FOREIGN PATENT DOCUMENTS

| | | | |
|---|---|---|---|
| CH | 695306 | A5 | 3/2006 |
| CN | 1048988 | A | 2/1991 |
| CN | 1354629 | A | 6/2002 |
| CN | 101232825 | A | 7/2008 |
| DE | 1873551 | A | 6/1963 |
| DE | 9101928 | U1 | 6/1991 |
| DE | 4107025 | A1 | 9/1992 |
| DE | 202007004678 | U1 | 8/2007 |
| EP | 0182055 | A1 | 5/1986 |
| EP | 0289243 | A1 | 11/1988 |
| EP | 0769253 | A2 | 4/1997 |
| EP | 1163857 | A1 | 12/2001 |
| EP | 1754419 | A1 | 2/2007 |
| EP | 2289357 | A1 | 3/2011 |
| FR | 2345092 | A1 | 10/1997 |
| GB | 1065204 | A | 4/1967 |
| GB | 1308661 | A | 2/1973 |
| JP | 61-100180 | A | 5/1986 |
| JP | 356396 | U | 5/1991 |
| JP | 04-121179 | A | 4/1992 |
| JP | H09107942 | A | 4/1997 |
| JP | 09-187266 | A | 7/1997 |
| JP | H10279986 | A | 10/1998 |
| JP | 200255604 | A | 9/2000 |
| JP | 2005245258 | A | 9/2005 |
| JP | 2009519034 | A | 5/2009 |
| WO | 0245531 | A1 | 6/2002 |
| WO | 2007123046 | A1 | 11/2007 |
| WO | 2009144496 | A1 | 12/2009 |
| WO | 2009157240 | A1 | 12/2009 |
| WO | 2010003899 | A1 | 1/2010 |
| WO | 2010032032 | A1 | 3/2010 |

OTHER PUBLICATIONS

Notice of Opposition for European Application No. 12731411.0 dated Mar. 21, 2017.

Office Action, dated Jul. 15, 2014, for CN Application No. 201280031954.8, filed Jun. 27, 2012.

International Search Report and Written Opinion, dated Dec. 3, 2012, for PCT/EP2012/062496, filed Jun. 27, 2012.

Henry G. Horsewell, "Filters for Cigarette Smoke", Chemistry and Industry, Jun. 7, 1975.

Opposition against European Patent 2 723 200; Dated Apr. 27, 2018.

CN Office Action dated Feb. 27, 2018 re: Application No. 201510402679.1 pp. 1-12, citing: CN101232825A, GB1065204A and CN1048988A.

JP Communication with office action dated Oct. 2, 2018 re: Application No. 2017-195040, pp. 1-8, citing: JP 3-056396 U, U.S. Pat. No. 4,809,718 A, WO 2009/144496 A1 and WO 2010/032032 A1.

Extended European Search Report dated Jan. 24, 2019 re: Application No. 18192049.7, pp. 1-12, citing: CH 695 306 A5, CA 2 631 413 A1, EP 1 163 857 A1, U.S. Pat. No. 4,319,590 A and JP H03 56396 U.

JP Office Action dated Apr. 28, 2020 re: Application No. 2017-195040, pp. 1-7, citing: WO 20091157240 A1 , U.S. Pat. No. 4,809,718 A, JP 1-115859 A, JP 9-107942 A and JP 2005-245258 A.

* cited by examiner

SMOKING ARTICLE FILTER AND INSERTABLE FILTER UNIT THEREFOR

CLAIM FOR PRIORITY

This application is a National Stage Entry entitled to and hereby claiming priority under 35 U.S.C. §§ 365 and 371 to corresponding PCT Application No. PCT/EP2012/062496, filed Jun. 27, 2012, which in turn claims priority to British Patent Application No. GB1110863.6, filed Jun. 27, 2011, and which also claims priority to British Patent Application No. GB1209426.4, filed May 28, 2012. The entire contents of the aforementioned applications are herein expressly incorporated by reference.

FIELD

The invention relates to smoking article filters and insertable filter units.

BACKGROUND

Cigarettes and other smoking articles contain a charge of tobacco which may be combusted to produce smoke which is inhaled by a user. Filters for smoking articles are used to modify the smoke resulting from the combustion of tobacco before it reaches the user's mouth. Filters known in the art for this purpose may be formed from a plug of fibrous cellulose acetate or other materials with similar physical properties. Cellulose acetate is known to absorb particulate smoke constituents in particular.

To enhance the removal of certain smoke constituents various additives may be added to smoking article filters. Examples include smoke adsorbents such as activated carbon which adsorbs certain smoke constituents thus removing them from the smoke stream passing through the filter.

In addition to removing constituents from smoke, filter additives may impart characteristics to smoke passing through the filter. For example, fragrances and flavourants may be incorporated which alter the aroma and taste characteristics of smoke that has passed through the filter.

Traditionally, smoking articles with filters incorporating the features described above are sold together in packs, with the smoking articles in each pack sharing the same flavours, fragrances and sorbent characteristics. As such, a user cannot customise his smoking articles to deliver a smoke profile to his choosing.

SUMMARY

Embodiments of the invention described in more detail hereinafter provide an insertable filter unit for a smoking article filter, the filter unit comprising a retaining means to retain the insertable filter unit in the smoking article filter.

The retaining means may comprise mechanical retaining means or may comprise an adhesive.

The insertable filter unit may be formed from a manually compressible material.

The insertable filter unit may have an end-on cross-sectional shape arranged to increase the surface area of the insertable filter unit.

Embodiments of the invention described in more detail hereinafter provide an insertable filter unit comprising a smoke modifying substance.

The smoke modifying substance may be stored in a frangible capsule contained within the insertable filter unit.

The frangible capsule may contain water.

The smoke modifying substance may be in granule form or in thread form.

The smoke modifying substance may comprise a carbon adsorbent.

The carbon adsorbent may have a monolithic structure.

The smoke modifying substance may comprise a colourant.

The smoke modifying substance may comprise a flavourant.

The flavourant may comprise at least one of: menthol, lemon, orange, lime, coffee and/or tea.

The smoke modifying substance may comprise water.

Embodiments of the invention described in more detail hereinafter provide a smoking article filter comprising a recess for receiving an insertable filter unit.

The recess may be at least partially circumscribed by a wall formed from filtration material.

The recess may be at least partially circumscribed by a wall formed from paper.

Embodiments of the invention described in more detail hereinafter provide a smoking article filter comprising a recess having filter unit retaining means arranged therein.

The filter unit retaining means may comprise mechanical retaining means.

The retaining means may comprise a buccal end closure.

The retaining means may comprise an adhesive applied to a major surface of the recess.

A kit of parts comprising an insertable filter unit and a smoking article filter may be provided.

The above advantages and features are of representative embodiments, presented to assist in understanding the invention, and are not exhaustive and/or exclusive. It should be understood that they are not to be considered limitations on the invention as defined by the claims, or limitations on equivalents to the claims. Additional features and advantages of the invention will become apparent in the following description, from the drawings, and from the claims.

BRIEF DESCRIPTION OF THE DRAWINGS

So that the present invention may be readily understood embodiments thereof will now be described for illustrative purposes only with reference to the accompanying drawings, in which.

DETAILED DESCRIPTION

Figure 1:
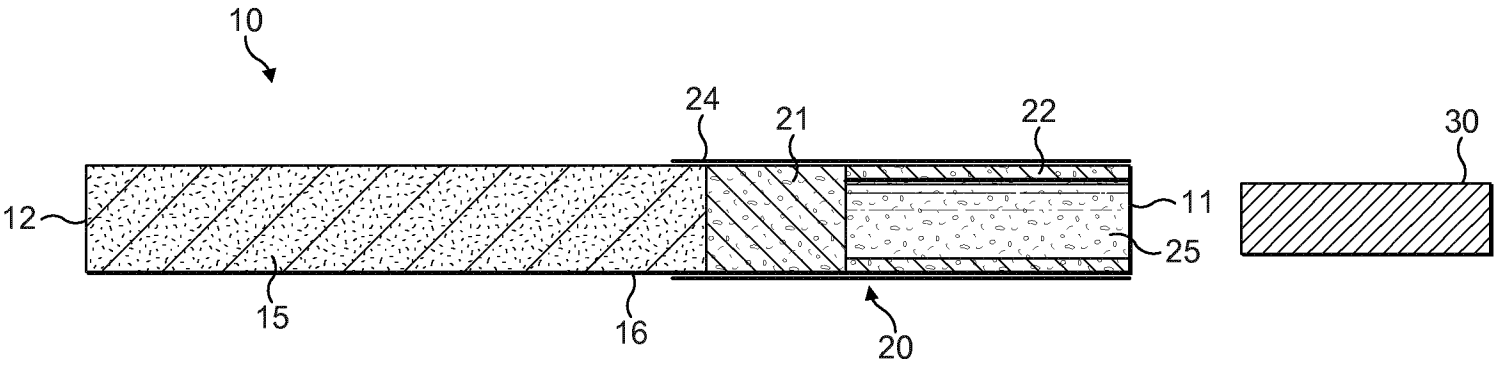
FIG. 1 is a side-on cross sectional view of a smoking article and filter insert unit in accordance with a first embodiment of the present invention.

FIG. 1 shows a smoking article 10 having a buccal end 11 and a distal end 12. The smoking article 10 comprises a tobacco rod 15 and a filter 20 attached thereto. The tobacco rod 15 is wrapped in tobacco wrapping paper 16.

Figure 2:
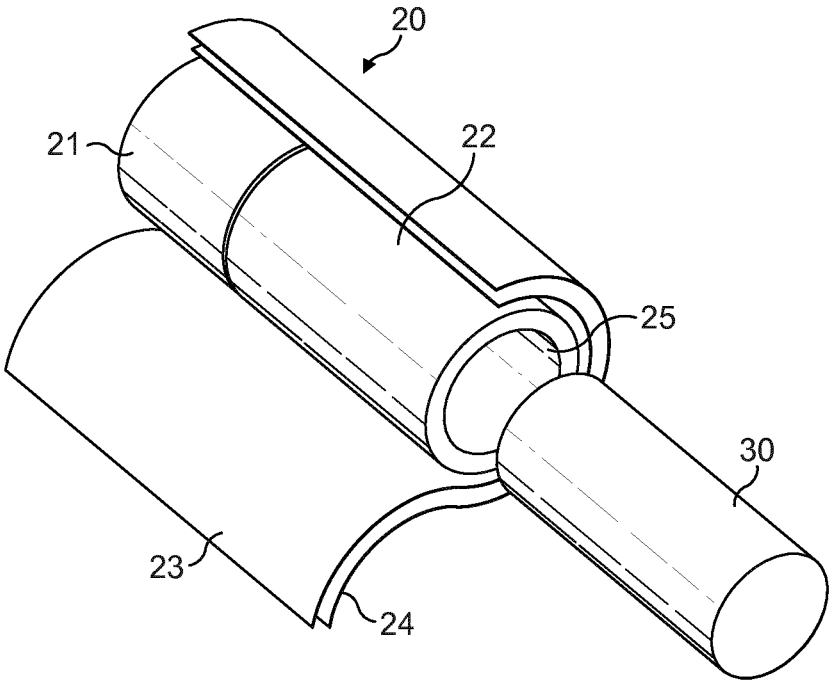
FIG. 2 is a perspective view of the filter and filter insert unit shown in FIG. 1.

The filter 20 is shown in more detail in FIG. 2. The filter 20 comprises a cylindrical filtration region 21 and a tubular filtration region 22 downstream of the cylindrical filtration region 21. The cylindrical filtration region and the tubular filtration region 22 may be formed from filtration material such as fibrous cellulose acetate or other material known in the art.

The cylindrical filtration region 21 may be about 12 mm in length and the tubular filtration region 22 may be about 15 mm in length.

The filtration material of the cylindrical filtration region 21 may be impregnated with adsorbent material such as activated carbon which may be in bead, granule or thread form.

Figure 3:
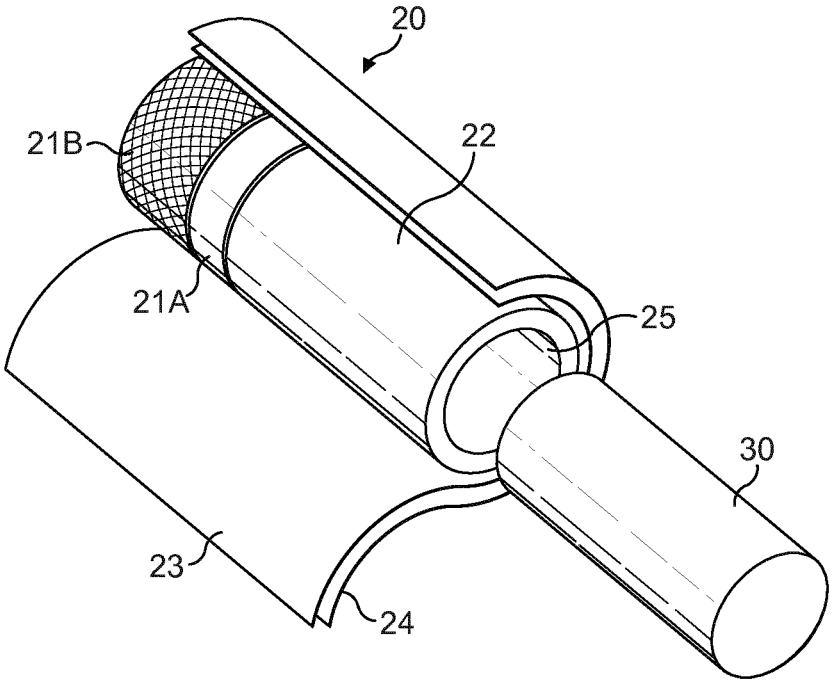
FIG. 3 is a perspective view of a filter and filter insert unit according to a second embodiment of the present invention.

An embodiment of the filter 20 containing an activated carbon section is shown in FIG. 3. In this embodiment the cylindrical section 21 is a dual filter section comprising a region of filtration material 21A such as cellulose acetate and an upstream region 21B comprising activated carbon. The region of filtration material 21A may be about 5 mm in length and the region 21B comprising activated carbon may be about 7 mm in length. Alternatively, the cylindrical section 21 may be provided as a triple filter section, comprising two regions of filtration material without activated carbon on either side of a central region comprising activated carbon.

The cylindrical region 21 and the tubular filtration region 22 may be wrapped in a plugwrap 23. The filter 20 may be attached to the tobacco rod 15 using tipping paper 24 which circumscribes the filter 20. The tipping paper 24 shown in FIGS. 1-3 is slightly longer than the filter 20 so that an overlap is formed when the tipping paper 24 is wrapped around the filter 20. This overlap may have some form of adhesive, such as glue, applied to the inner surface thereof which, in use, adheres to the outer surface of the tobacco wrapping paper 16. Other attachment means for attaching the filter 20 to the tobacco rod 15 that are known in the art may also be employed.

In certain embodiments, the plugwrap 23 may be provided with carbon granules adhered to an inside surface of said plugwrap 23 in patches using a suitable adhesive.

The filter 20 has a recess 25, defined by the cylindrical filtration region 21 and the tubular filtration region 22, the recess 25 extending from the buccal end 11 arranged to accommodate a cylindrical filter insert unit 30. The recess 25 extends at least along part of the length of the filter 20. The shape of the recess 25 may be designed to match the shape of the filter insert unit 30. In the embodiments shown in FIGS. 1-3, the cylindrical filter insert unit 30 matches the hollow cylindrical shape of the recess 25.

Figure 4:
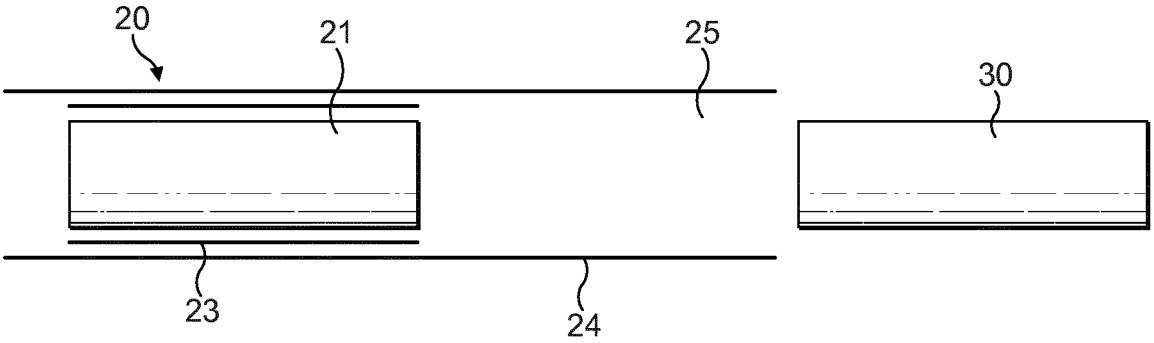
FIG. 4 is a side view of a filter and filter insert unit according to a third embodiment of the present invention.

FIG. 4 shows an alternative filter 20. In this embodiment the tipping paper 24 which wraps the cylindrical filtration material 21 is formed from a rigid card-like material which extends beyond the buccal end of the cylindrical filtration material 21 to form a recess 25 into which filter insert units 30 may be inserted. In this embodiment, no tubular filtration region 22 is employed.

An alternative to the filter 20 shown in FIG. 4 is a configuration similar to that shown in FIG. 2 except that the tubular filtration region 22 is replaced with a cardboard tube. In this embodiment the tipping paper 24 would be formed from conventional tipping paper material that is less rigid than the card-like material described above with reference to FIG. 4. In this alternative embodiment, the plugwrap 23 may be shorter than that shown in FIG. 2, circumscribing only the cylindrical filtration material 21.

The filter insert unit 30 may have varying dimensions, such as length and diameter, and may be used in conjunction with smoking articles of varying dimensions. Filters 20 and filter insert units 30 may be used in conjunction with varieties of smoking articles with dimensions ranging from 'demislim' to 'king size'—terms which are well known in the art. Preferably, the filter insert unit has a length between about 5 mm and about 20 mm.

The filter insert unit 30 may be formed from filtration material such as cellulose acetate or other smoking article filtration material known in the art and may be wrapped circumferentially with a plugwrap or other suitable material. The wrapper may be embossed with raised areas being about 1 mm in size according to one embodiment. The material may act as a particulate absorbent of smoke constituents.

In one embodiment, the filter insert unit 30 comprises non-wrapped acetate fibres bound together using a level of plasticiser higher than levels of plasticiser used in embodiments where the filter insert unit 30 is wrapped.

In another embodiment, the filter insert unit 30 may comprise randomly oriented discrete short length cellulose acetate fibres and may be manufactured using a manufacturing apparatus such as the Turmalin apparatus available from Hauni Maschinenbau AG in Germany.

The filter insert unit 30 may comprise reconstituted tobacco paper or compressed cut tobacco leaf which may be wrapped in reconstituted paper or a plugwrap of a type known in the art. The filter insert unit 30 may contain one or more flavourants in liquid form or in other forms such as granules, particles or the like.

Tobacco rods, formed in a conventional manner, may be cut to dimensions suitable for use as a filter insert unit 30 and may be wrapped using a suitable wrapper such as cigarette paper or a plugwrap. The wrapper may be embossed with individual raised areas being less than about 1 mm in size according to one embodiment.

In embodiments of the filter insert unit 30 that have embossed wrappers, the full length of the filter insert unit 30 may be embossed or only a partial length of the filter insert unit 30 may be embossed. The filter insert unit 30 may be embossed in a banded pattern.

The filter insert unit 30 may be arranged to achieve an effect which is known in the art as the Dalmatian effect. The Dalmatian effect may be achieved using carbon granules, tobacco in whole leaf form, reconstituted tobacco or other botanicals or their derivatives, such as menthol, added to filter tow, such as cellulose acetate tow, to produce a mottled effect.

The filter insert unit 30 may comprise a combination of a filtration material such as cellulose acetate with reconstituted tobacco paper and/or compressed cut tobacco leaf and/or materials used to obtain a visual Dalmatian effect and/or a thread. In this case, the filter insert unit 30 may be wrapped in reconstituted tobacco paper or a plugwrap of a type known in the art.

The filter insert unit 30, according to any of the above described embodiments, may comprise flavourants such as, for example only, menthol, lemon, orange, lime, coffee or tea. Leaf based flavourants, such as tobacco, menthol, tea and so forth, may be added to the filter insert unit 30 in whole leaf form and/or as extracts.

In some embodiments, the filter insert unit 30 may comprise cut laminar tobacco and/or one or more additives selected from mint, borage, tea, various herbs or any other suitable additive.

The filter insert unit 30, when inserted, is arranged to modify characteristics of smoke as the smoking article 10 is smoked by a user.

It should be understood that the smoking article 10 may equally be smoked with no filter insert unit 30 inserted in the recess 25. The materials of the cylindrical filtration region 21, tubular filtration region 22 may be such as to provide a pressure drop that corresponds to the pressure drop of a conventional smoking article when a user draws on the buccal end 11 of the smoking article 10. The filter insert unit 30 may be arranged not to alter the pressure drop significantly when inserted into the recess 25 of the filter 20.

The filter 20 may contain flavourants such as menthol and so forth. Filter insert units 30 intended for insertion into mentholated or otherwise flavoured smoking articles may contain additives arranged to complement the smoking experience of the smoking article.

The filter insert unit 30 may contain water. Preferred water-containing filter insert units 30 comprise capsules such as the capsule 42 described below with reference to FIG. 15 with the water stored inside the capsule 42.

Adsorbents such as activated carbon granules, capsules or threads may also be incorporated into the filter insert unit 30.

In one embodiment, the filter insert unit 30 may comprise activated carbon granules packed together using a binder.

In an alternative embodiment, the filter insert unit 30 may comprise carbon having a monolithic structure. Monolithic carbon structures, or carbon monoliths, are units of carbon which are not granular, but, in common with granular activated carbon, have a large surface area. Carbon monoliths do not require the use of a binder, so that the surface area of the carbon that can be used to adsorb target smoke constituents may be increased with respect to carbon structures that use a binder. Suitable monolithic carbon structures can be formed by extrusion and an example of a suitable monolithic structure and method of producing the same is described in US2005126395, the contents of which are hereby incorporated by reference in their entirety.

Colourants may also be incorporated and may provide a visual cue to a user, for example to provide an indication of the contents of the filter insert unit 30 such as flavourants or adsorbents. For example, a green colourant may be used to indicate that the filter insert unit 30 is mentholated.

If a filter insert unit 30 is to be inserted into the filter 20 of a smoking article 10 it may be useful to provide additional means for securing the filter insert unit therein. FIGS. 5 to 20 illustrate a variety of examples of filters 20, filter insert units 30 and the way in which they are retained in the filter 20. In the description below it should be understood that retaining means indicates structure that retains beyond what may be achieved by ordinary frictional contact between two substantially flat surfaces in contact.

For illustrative reasons only, tobacco rods such as the tobacco rod 15 shown in FIG. 1 have been omitted from the following figures. It is intended that the examples listed hereinafter are consistent with those set out above with any additional modifications that may be necessary being evident to those skilled in the art.

Figure 5:
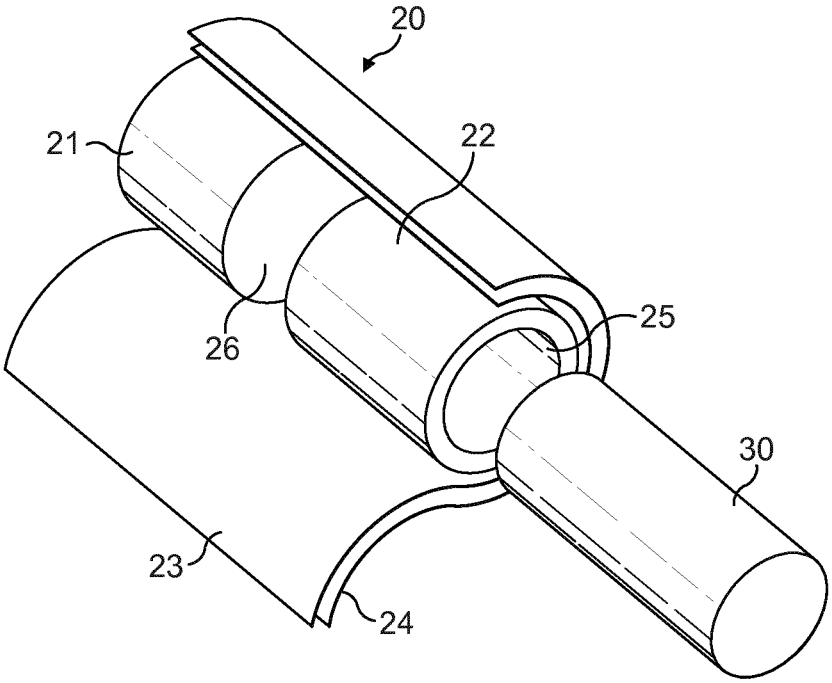
FIG. 5 is a perspective view of a filter and filter insert unit according to a fourth embodiment of the present invention.

FIG. 5 shows a filter 20 and filter insert unit 30 substantially similar to that described above with reference to FIGS. 1 and 2. However, this embodiment differs from that described above in that the tubular filtration region 22 is shorter in length than the tubular filtration region 22 shown in FIG. 2. A gap 26 is provided between the tubular filtration region 22 and the cylindrical filtration region 21. The filter insert unit 30 may be formed from a compressible material which, once inserted into the recess 25, expands at least partially into the gap 26. The filter insert unit 30 may thus be secured in the recess 25.

Figure 6:
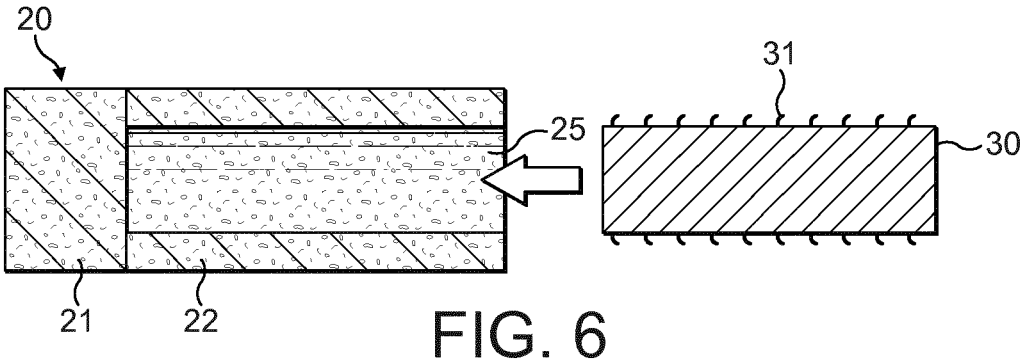
FIG. 6 is a side-on cross sectional view of a filter and filter insert unit according to a fifth embodiment of the present invention.

FIG. 6 shows an arrangement of a filter insert unit 30 and filter 20 comprising a recess 25. The filter insert unit 30 has a number of small hooks 31 arranged on the major surface thereof and the inner surface of the recess 25 may have a corresponding number of small loops (not shown) arranged thereon to engage with the hooks 31 when the filter insert unit 30 is inserted. For example, the filter insert unit 30 and/or the interior of the recess 25 may be provided with Velcro®. As such, once the filter insert unit 30 has been inserted into the recess 25, the resistance to removing the filter insert unit 30 is enhanced so that accidentally removing the filter insert unit 30 is more difficult.

Figure 7:
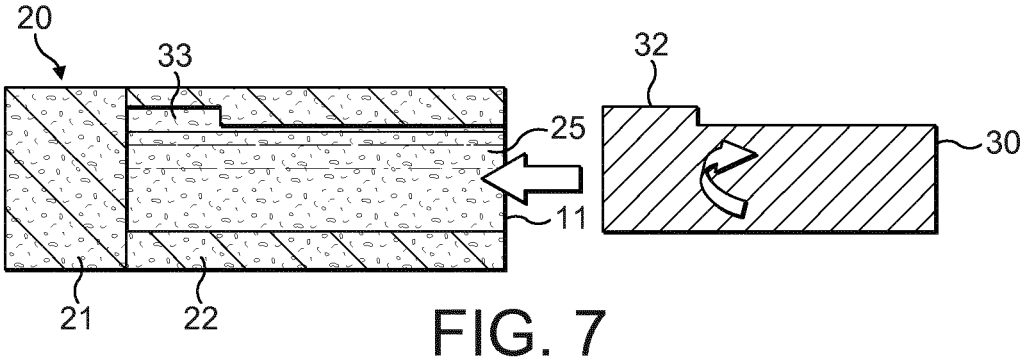
FIG. 7 is a side-on cross sectional view of a filter and filter insert unit according to a sixth embodiment of the present invention.

FIG. 7 shows a filter 20 and a filter insert unit 30 with an alternative mechanical locking means. The filter insert 30 has a raised locking part 32 situated on the outer surface and at one end of the filter insert unit 30. A corresponding depression 33, of complementary shape to the raised locking part 32, is situated in the recess 25 and may be located away from the buccal end 11 of the filter 20. Upon insertion, the filter insert unit 30 may be rotated to align the raised locking part 32 with the depression 33 in the recess 25 to secure the filter insert unit 30 in the recess 25 of the filter 20.

Figure 8:
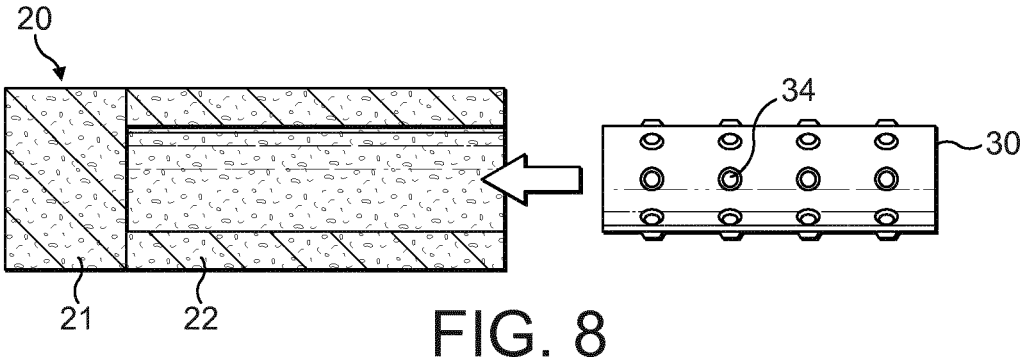
FIG. 8 is a side-on cross sectional view of a filter and filter insert unit according to a seventh embodiment of the present invention.

FIG. 8 shows a filter 20 and a filter insert unit 30 with yet another alternative mechanical locking mechanism. The surface of the filter insert unit 30 is provided with several raised spots 34 arranged thereon to improve the frictional fit between the recess 25 of the filter 20 and the filter insert unit 30. The raised areas may be formed by outwardly perforating an outer wrapper of the filter insert unit 30.

Securing the filter insert unit 30 inside the recess 25 of the filter 20 may alternatively be achieved by forming the filter 20 and the filter insert unit 30 from materials of differing compressibility.

Figure 9:
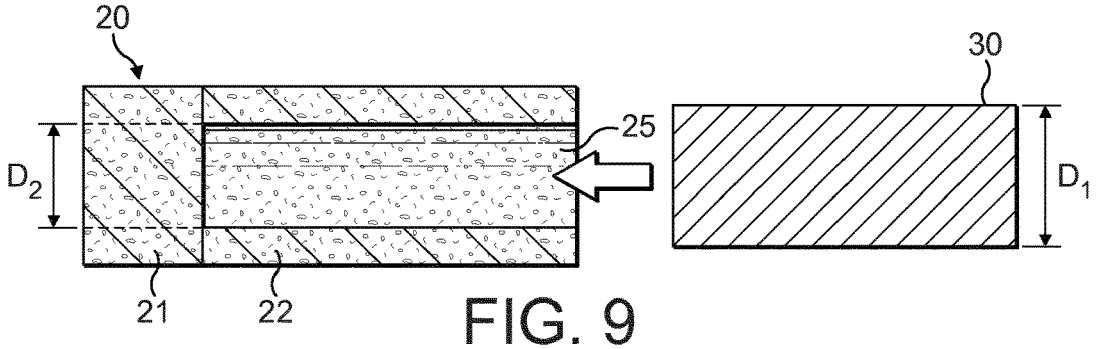
FIG. 9 is a side-on cross sectional view of a filter and filter insert unit according to an eighth embodiment of the present invention.

FIG. 9 shows a filter 20 with a recess 25 located therein and a filter insert unit 30. In this embodiment, the filter insert unit 30 is formed from a material that is softer than the material used to form the filter 20. In this embodiment, the diameter D1 of the filter insert unit 30 is greater than the diameter D2 of the recess 25. In use, the filter insert unit 30 may be compressed by a user to ease insertion. Once inserted, the outward pressure on the inner walls of the recess 25, exerted by the filter insert unit 30 returning towards its original, uncompressed dimensions serves to hold the filter insert unit 30 securely in place.

Figure 10:
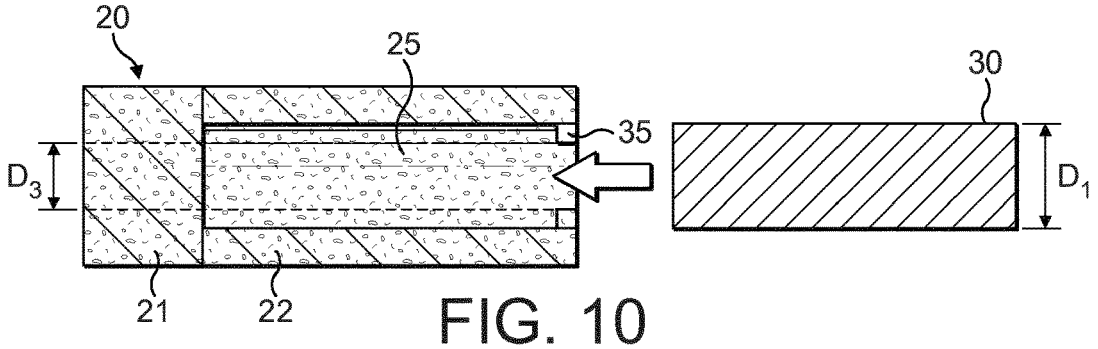
FIG. 10 is a side-on cross sectional view of a filter and filter insert unit according to a ninth embodiment of the present invention.

FIG. 10 shows an alternative embodiment which also relies on the compressibility of the filter insert unit material. An inwardly extending lip 35 is situated at the buccal end 11 of the filter 20. The diameter D3 of the recess 25 at the buccal end 11 where the lip 35 is located is smaller than the diameter D2 (shown in FIG. 9) of the remainder of the recess 25 as well as the diameter of the filter insert unit 30. Upon insertion, the filter insert unit 30 may be compressed to a smaller diameter so that it may be pushed past the lip 35 and into the recess 25. The filter insert unit 30 may then expand substantially back to its natural, uncompressed diameter and a secure fit between the filter insert unit 30 and the filter 20 may be obtained.

Figure 11:
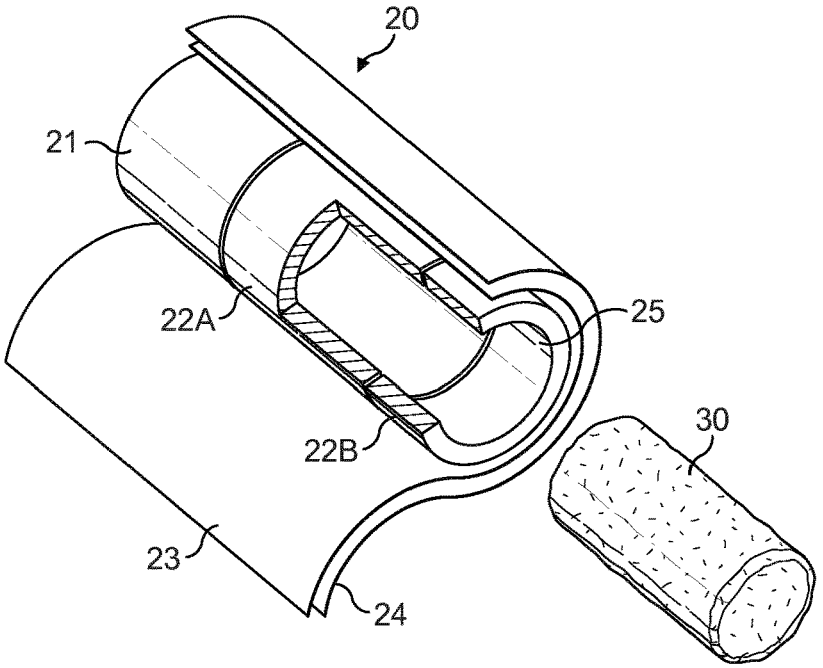
FIG. 11 is a perspective view of a filter and filter insert unit according to a tenth embodiment of the present invention.

FIG. 11 shows an alternative filter 20 where the tubular filter region 22 comprises an upstream portion 22A and a downstream portion 22B. The two portions 22A and 22B may have the same diameter or different diameters. In one embodiment, the downstream portion 22B may be of a smaller diameter than the upstream portion in which case the downstream portion 22B may act as a lip in a similar fashion to the lip 35 described above with reference to FIG. 10. In this embodiment the filter insert unit 30 may be formed from a manually compressible material.

Figure 12:
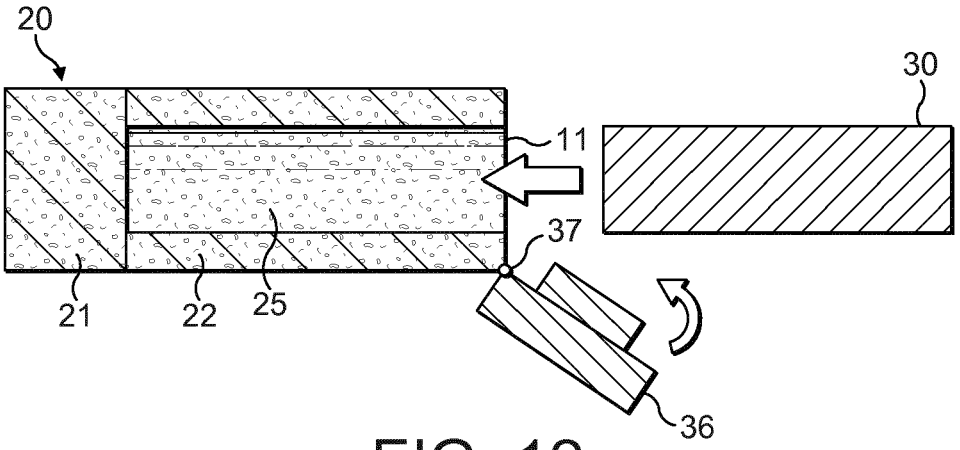
FIG. 12 is a side-on cross sectional view of a filter and filter insert unit according to an eleventh embodiment of the present invention.

FIG. 12 shows a filter 20 with an end cap 36 attached to the buccal end 11 thereof. The filter insert unit 30 is inserted and the end cap 36 may then be closed. The end cap 36 shown in FIG. 12 is hinged about a point 37 on the buccal end 11 of the filter 20 however other means for securing the end cap 36 to the filter 20 apparent to those skilled in the art may be used instead. The end cap 36 is formed from a material that is substantially permeable to smoke. The filter insert unit 30 may be dimensioned to allow the end cap 36 to be closed without compression. Alternatively, the end cap 36 may squeeze the filter insert unit 30 if the filter insert unit 30 is formed from a compressible material.

Figure 13:
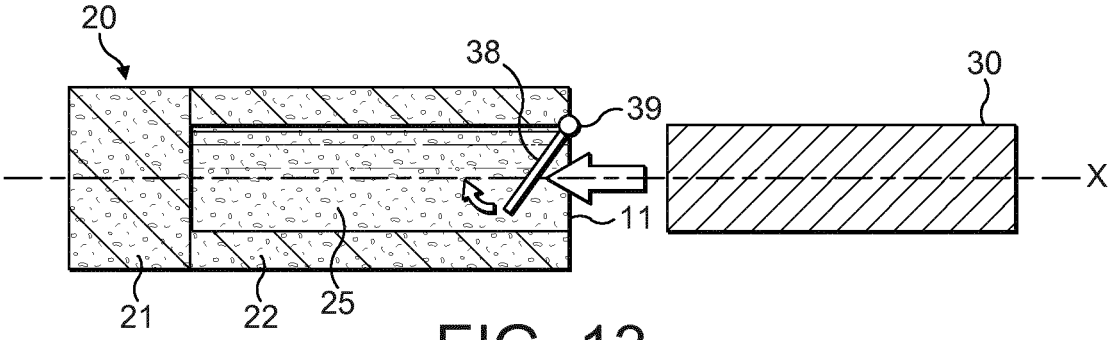
FIG. 13 is a side-on cross sectional view of a filter and filter insert unit according to a twelfth embodiment of the present invention.

A gate 38 may be attached to the buccal end 11 of the filter 20 about a pivot 39, as shown in FIG. 13. The gate 38 and pivot 39 may be arranged so that the gate 38 opens inwardly (as shown by the curved arrow) but not outwardly. In use, the filter insert unit 30 is pushed into the recess 25 of the filter 20 and in so doing the gate 38 is pushed inwardly such that it is substantially parallel to the longitudinal axis X of the filter 20 as shown in FIG. 13. If the filter insert unit 30 is manufactured from a manually compressible material pressure may then be applied to compress the filter unit 30 so that the end nearest the buccal end 11 of the filter 20 is pushed past the gate 38. The gate 38 may be biased so that it returns to a position substantially perpendicular to the longitudinal axis X when the gate 38 is unobstructed.

Figure 14:
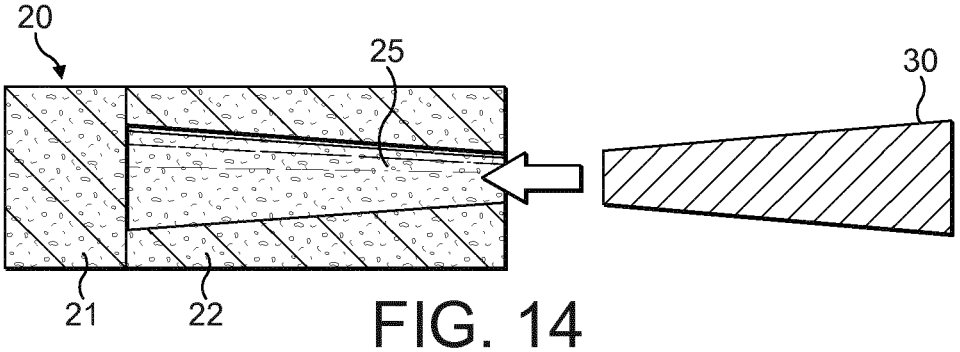
FIG. 14 is a side-on cross sectional view of a filter and filter insert unit according to a thirteenth embodiment of the present invention.

FIG. 14 shows an alternative embodiment of the filter 20 with a recess 25 located therein and the filter insert unit 30. In side-on cross-section, as shown in FIG. 14, the recess 25 and filter insert unit 30 appear trapezoidal. A filter insert unit 30 formed from a manually compressible material and which is rectangular in cross-section may also be inserted into a cross-sectionally trapezoidal recess 25 to obtain a secure fit.

Figure 15:
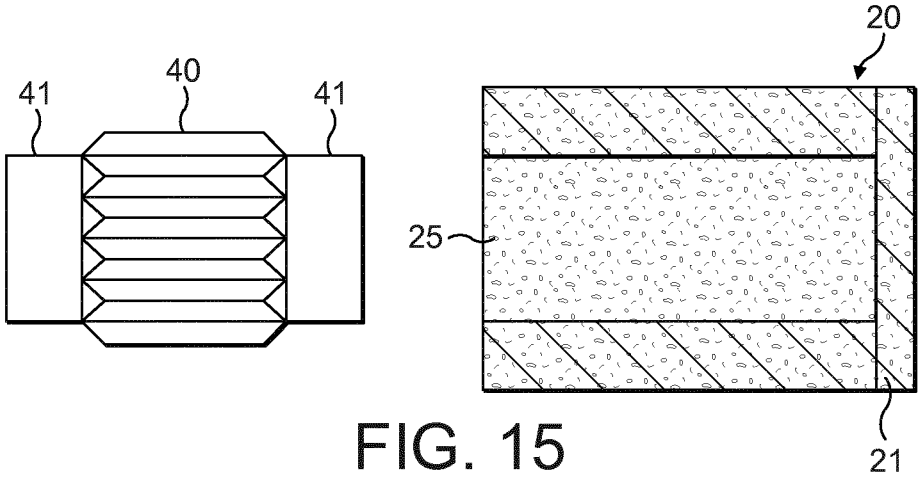
FIG. 15 is a side-on cross sectional view of a filter and filter insert unit according to a fourteenth embodiment of the present invention.

FIG. 15 shows an alternative embodiment of the invention with a filter 20 with a recess 25 located therein and a filter insert unit 30 with compressible flutes 40 located thereon. The flutes 40 are formed from a plurality of ridges radially disposed about the filter insert unit 30 and extending substantially parallel to the axis and along part of the length of the filter insert unit 30. The parts of the filter insert unit 30 not covered by the flutes 40 form bar sections 41.

In use, the bar sections 41 provide means for gripping the filter insert unit 30 and locating the filter insert unit 30 in the recess 25 of the filter 20. Before insertion, the flutes 40 are biased so as to protrude outwards from the rest of the filter insert unit 30. Once the filter insert unit 30 has been fully inserted into the recess 25 the flutes 40 are compressed thus ensuring a secure fit.

Figure 16:
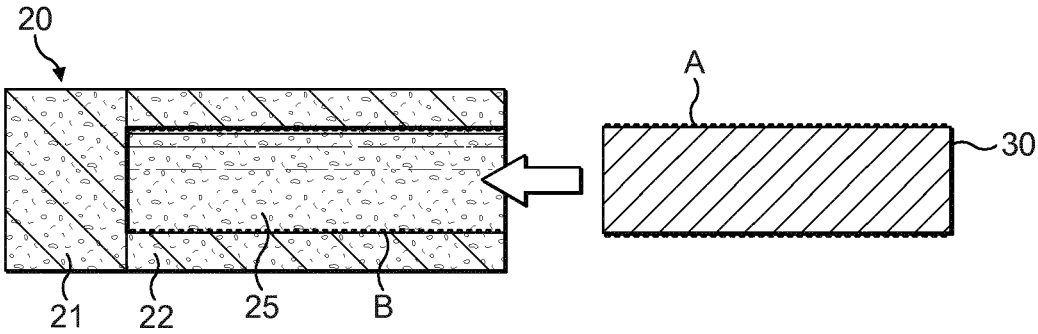
FIG. 16 is a side-on cross sectional view of a filter and filter insert unit according to a fifteenth embodiment of the present invention.

An alternative to providing mechanical locking mechanism is to provide a chemical locking mechanism such as that shown in FIG. 16. The outer surface of the filter insert unit 30 is coated with an adhesive A and the inner surface of the recess 25 coated with an adhesive B. In use, as the filter insert unit 30 is inserted into the recess 25 adhesive A comes into contact with the adhesive B and a chemical reaction leads to a bond being formed between the filter 20 and the filter insert unit 30.

Figure 17:
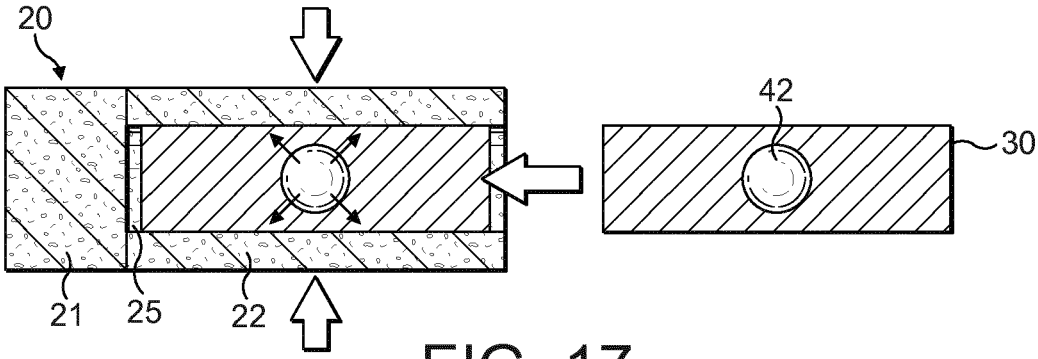
FIG. 17 is a side-on cross sectional view of a filter and filter insert unit according to a sixteenth embodiment of the present invention.

Alternatively, the filter insert unit 30 may contain a frangible capsule 42, as shown in FIG. 17. Once the filter insert unit 30 has been inserted into the recess 25, the filter 20 is squeezed inwardly in the direction of the mutually facing arrows shown in FIG. 17. The frangible capsule 42 is ruptured and adhesive stored therein is released. The insert unit 30 may be formed from a material that allows migration of the adhesive to the outer surface of the insert unit 30. The adhesive bonds the filter 20 and the filter insert unit 30 together.

The frangible capsule 42 may contain water as well as, or instead of, adhesive together with any flavourant, colourant or sorbent described herein.

Figure 18:
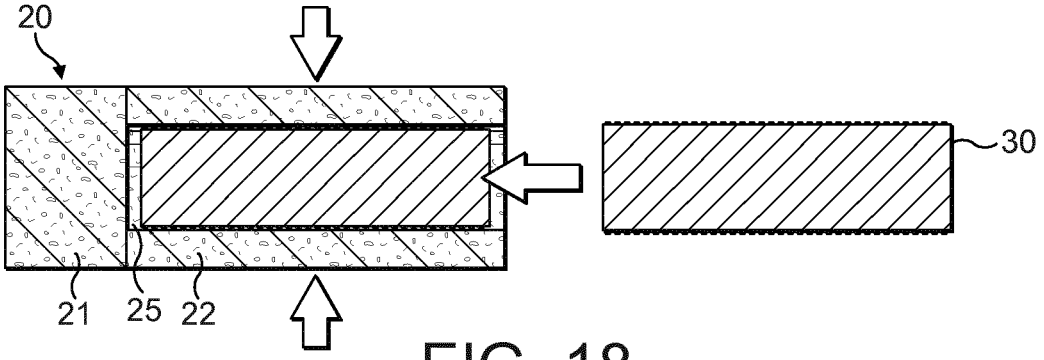
FIG. 18 is a side-on cross sectional view of a filter and filter insert unit according to a seventeenth embodiment of the present invention.

An alternative arrangement of adhesive between the filter 20 and the filter insert unit 30 is shown in FIG. 18. In this embodiment adhesive is applied to the outer surface of the insert unit 30 only. Once the filter insert unit 30 has been inserted into the recess 25 of the filter 20, the outer surface of the filter 20 may be squeezed in the direction shown by the mutually facing arrows. The pressure thereby applied to the adhesive on the outer surface of the filter insert unit 30 is such as to cause the adhesive to bond the filter 20 to the filter insert unit 30.

Figure 19:
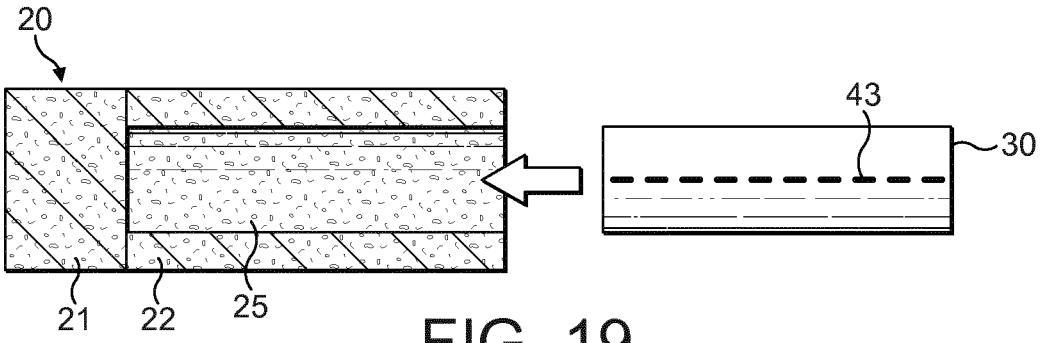
FIG. 19 is a side-on cross sectional view of a filter and filter insert unit according to an eighteenth embodiment of the present invention.

Alternatively, adhesive may be applied to the outer surface of the insert unit 30 as shown in FIG. 19. The adhesive may be applied in one or more radially disposed strips 43 which extend the length of the filter insert unit 30. Prior to use the strips may be covered by a protective cover which is removed immediately before insertion of the filter insert unit 30 into the recess 25 of the filter 20. The adhesive strips 43 then adhere the filter insert unit 30 to the inside of the recess 25 of the filter 20.

While the filter insert unit 30 described above may be formed from filtration material such as cellulose acetate, other materials may alternatively be employed. For example, the filter insert unit 30 may be formed from wax or a similar substance. Once inserted, the insert unit 30 may melt slightly due to heat transferred from the distal end 12 of the smoking article 10 shown in FIG. 1, during smoking. The filter insert unit 30 may thus be adhered to the inner surface of the recess 25 of the filter 20. The slight melting of the wax may also aid the release of flavourants and fragrances contained within the filter insert unit 30.

Figure 20:
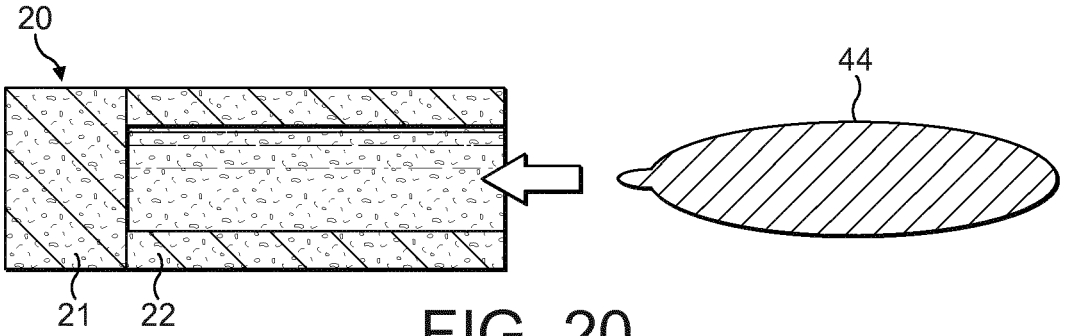
FIG. 20 is a side-on cross sectional view of a filter and filter insert unit according to a nineteenth embodiment of the present invention.

FIG. 20 shows an alternative filter insert unit 44 in capsule form formed from gelatine or other substances with similar physical properties. Such a filter insert unit 44 may be arranged to adopt the shape of the recess 25 once it is inserted therein. The filter insert unit 44 in capsule form may be frangible so that it bursts and releases its contents when the filter insert unit 44 has been inserted and the filter 20 squeezed.

Figure 21:
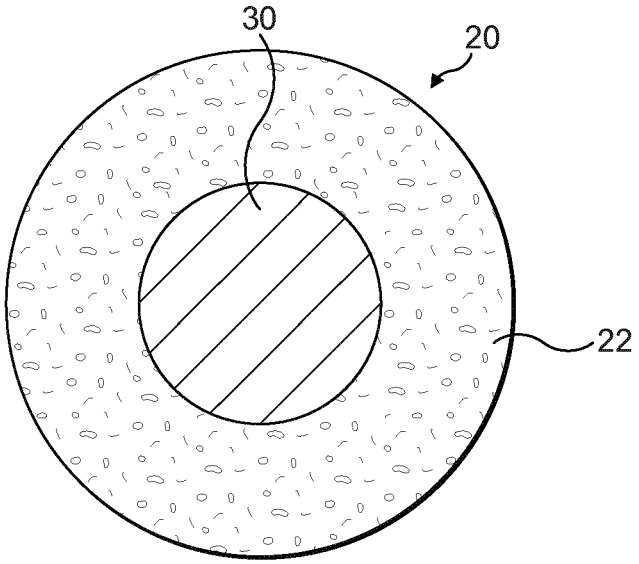
FIG. 21 is an end-on cross sectional view of the filter insert unit shown in any of FIGS. 1-19 inserted in any of the filters shown in FIGS. 1, 2, 4-19.

While the filter insert unit 30 described above with reference to FIGS. 1-20 is intended for insertion in a recess 25 which is circular in end-on cross-section, as shown in FIG. 21, recesses of different cross-sectional shapes may also be used.

Figure 22:
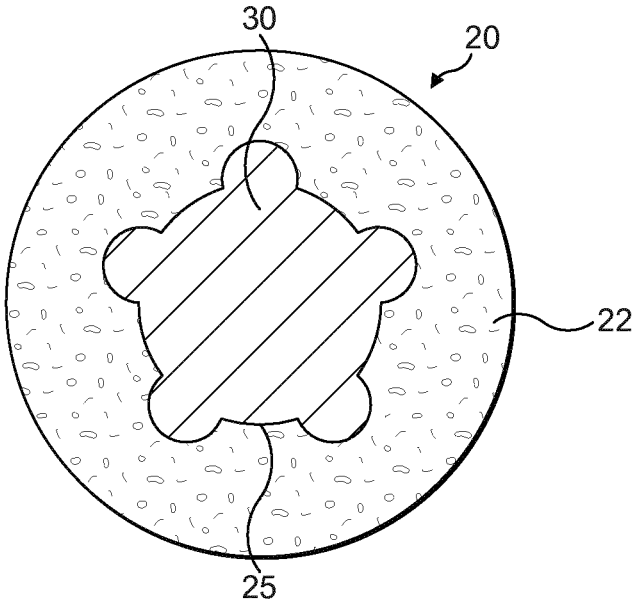
FIG. 22 is an end-on cross sectional view of a filter insert unit with an alternative cross-sectional shape inserted in a complementarily shaped filter.

FIG. 22 is an end-on view showing the buccal end 11 of a filter 20 of a smoking article 10. The outline of the recess 25 as viewed end-on is irregular and an insert unit 30, when viewed end-on, is complementary in shape to achieve a secure fit. Irregular end-on cross-sectional shapes such as that shown in FIG. 22 are advantageous since they increase the surface area of the interface between the filter insert unit 30 and the filter 20.

Figure 23:
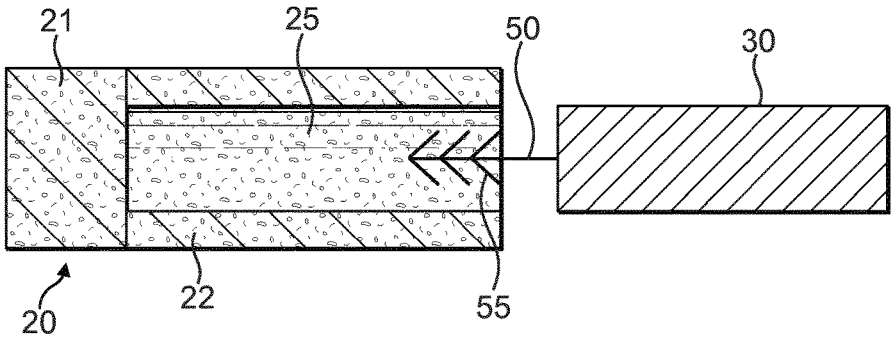
FIG. 23 is a side-on cross sectional view of a filter and filter insert unit according to a further embodiment of the present invention.

FIG. 23 shows a filter 20 and a filter insert unit 30 according to a further embodiment. In this embodiment, the filter insert unit 30 is provided with a spike 50. The spike 50 may comprise one or more barbs 55. When the filter insert unit 30 is inserted into the recess 25 of the filter 20 the spike 50 and barbs 55 become at least partially embedded within the cylindrical filtration region 21 of the filter 20 which assists in retaining the filter insert unit 30 in the filter 20.

Figure 24:
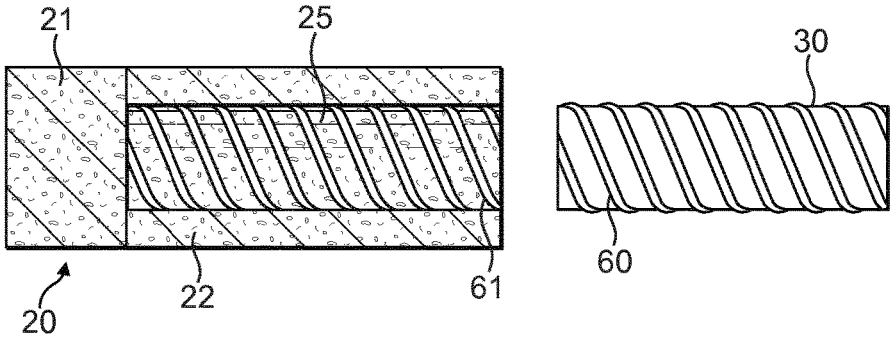
FIG. 24 a side-on cross sectional view of a filter and filter insert unit according to a further embodiment of the present invention.

In a further embodiment shown in FIG. 24, the filter insert unit 30 comprises an outer screw thread 60 arranged around the outer surface of the filter insert unit 30. The recess 25 of the filter 20 may also comprise an inner screw thread 61 arranged along the inner surface of the recess 25. As the filter insert unit 30 is inserted it may be twisted such that the outer screw thread 60 and inner screw thread 61 engage so that the filter insert unit 30 may be retained inside the recess 25 of the filter 20.

The screw threads 60, 61 may be provided as a moulded or extruded filler material or plastic. Alternatively, the screw thread may be formed by embossing the inner surface of the recess 25 and/or the outer surface of the filter insert unit 30, for instance in the case that the recess is formed by a stiff paper or card-like material which can be embossed, or where a plug wrap surrounding the filter insert unit 30 can be embossed. The screw threads 60, 61, in some embodiments, may be provided in one or other but not both of the filter insert unit 30 and recess 25, providing channels between the screw threads along which smoke may pass in use.

Figure 25A:
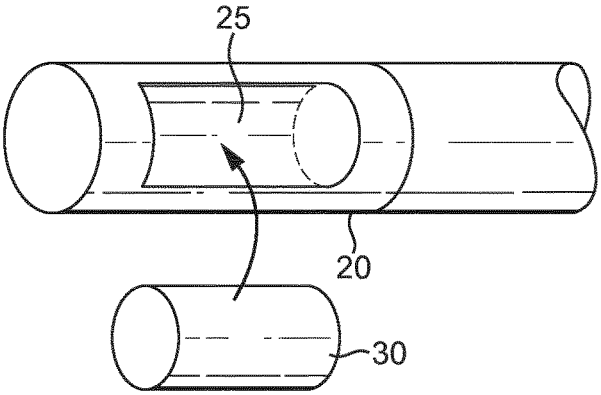
FIG. 25A is a three dimensional view of another embodiment of the present invention.
Figure 25B:
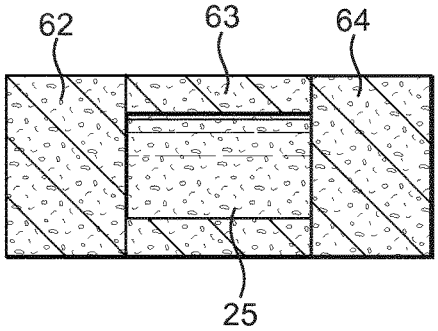
FIG. 25B is a side-on cross sectional view of a filter according to an embodiment of the present invention.

In a further embodiment, a filter insert unit 30 may be inserted into the recess 25 through an opening located along the side of the filter 20 as shown in FIG. 25A. FIG. 25B shows a filter 20 according to such an embodiment. A downstream cylindrical filtration region 62, an intermediate tubular filtration region 63 and an upstream cylindrical filtration region 64 are located end to end as shown in FIG. 25B. The intermediate tubular filtration region 63 has a portion cut away to allow insertion of the filter insert unit 30 therein. Plugwrap, tipping paper, or any other suitable wrapper that may be used to hold the downstream cylindrical filtration region 62, the intermediate tubular filtration region 63 and the upstream cylindrical filtration region 64 in place may also have a cutaway portion to allow insertion of the filter insert unit 30 into the recess 25. In use, the downstream cylindrical filtration region 62 retains the filter insert unit 30 in place inside the filter 20.

Figure 26:
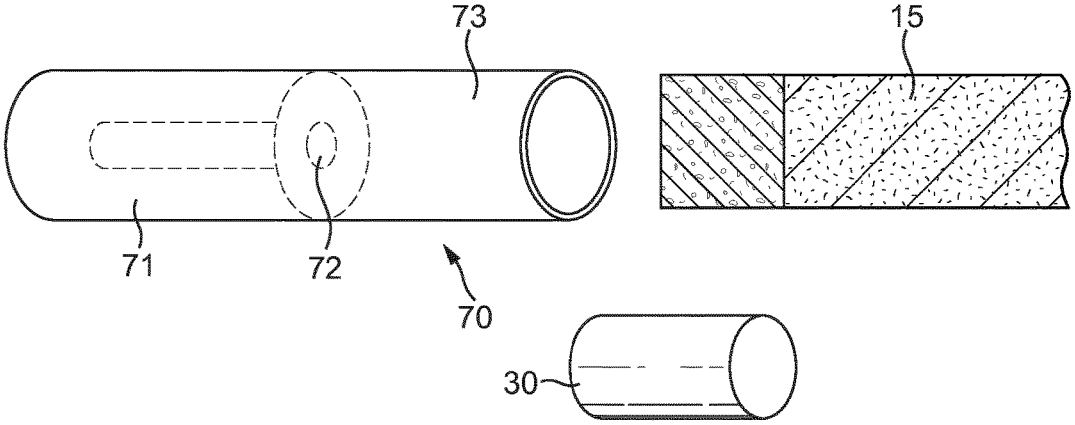
FIG. 26 is a side-on view of another embodiment of the present invention.

FIG. 26 shows an embodiment where a filter insert unit 30 is inserted into a sleeve 70. The sleeve 70 comprises a cylindrical region 71 of filtration material such as cellulose acetate having a recess 72 extending part of the length of the cylindrical region 71 from an upstream end of the cylindrical region 71. The sleeve 70 further comprises a sleeve portion 73 which may consist of a rigid card overwapper longer than the cylindrical region 71 so that a smoking article may be inserted into the hollow area defined by the sleeve portion 73. In use, a filter insert unit 30 may be inserted into the recess 72 before the sleeve is placed over a smoking article so that the sleeve portion 73 overlies the mouth end of the smoking article. As such, the sleeve 70 retains the filter insert unit 30 in place during use.

Figure 27:
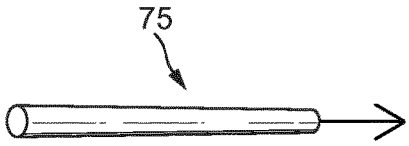
FIG. 27 is a side-on view of another embodiment of the present invention.

FIG. 27 shows an embodiment where the insertable filter unit is a spike 75 which may be inserted into a conventional smoking article filter. The spike 75 may be formed from a material comprising plastic, wood or any other suitable material. The spike 75 may have an additive such as a flavourant, or sorbent applied thereto to impart an organoleptic quality to smoke passing through a filter.

Figure 28A:
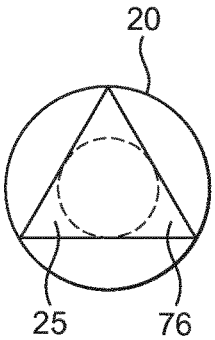
FIGS. 28A-C are end-on views of a filter and insert unit according to embodiments of the present invention.
Figure 28B:
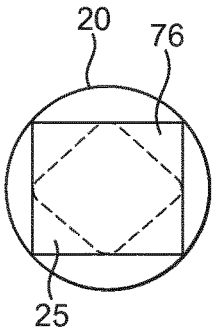
Figure 28C:
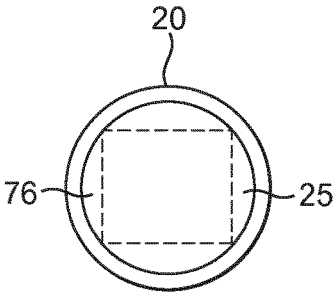

FIGS. 28A, 28B and 28C are end-on views of a filter 20 showing the buccal end 11 having a filter insert unit 30 inserted therein according to respective exemplary embodiments. In these embodiments the filter insert unit 30 and the recess 25 of the filter 20 have different cross sectional shapes when viewed from the rear.

FIG. 28A shows a filter insert unit 30 having a circular cross section inserted into a recess 25 having a triangular cross section. FIG. 28B shows a filter insert unit 30 having a circular cross section inserted into a recess 25 having a square cross section. FIG. 28C shows a filter insert unit 30 having a square cross section inserted into a recess 25 having a circular cross section. As may be seen from FIGS. 28A-C, using differently shaped filter insert units 30 and recesses 25 allows the formation of channel 76. The number and shape of such channels 76 may be varied by varying the combination of the shapes of the filter insert units 30 and recesses 25 as may be seen by when comparing FIGS. 28A-C. Such variation in shape may also lead to a compressive fit between the filter 20 and the filter insert unit 30 which can assist in retaining the filter insert unit 30 therein. It should be borne in mind that other combinations of shapes of filter insert unit 30 and recess 25 than those shown in FIGS. 28A-C may be employed.

Figure 29A:
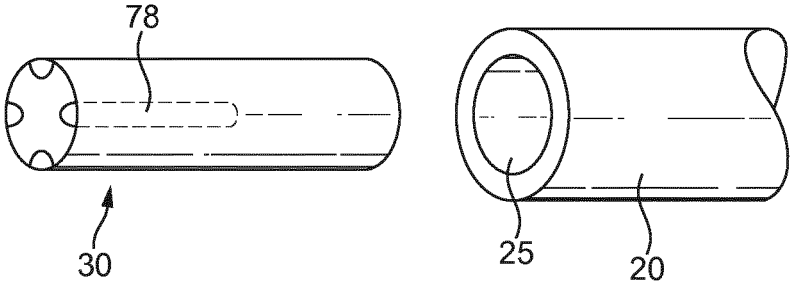
FIG. 29A is a side-on view of a filter and filter insert unit according to a further embodiment.
Figure 29B:
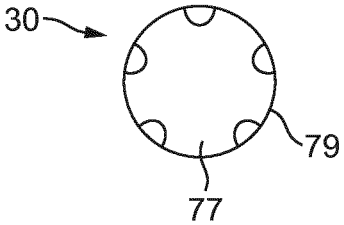
FIGS. 29B and 29C are end-on views of filter insert units according to further embodiments.
Figure 29C:
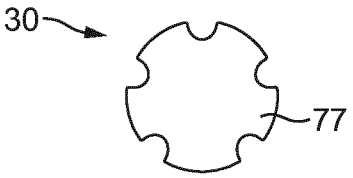

FIG. 29A shows a filter insert unit 30 according to a further embodiment. The filter insert unit 30 according to this embodiment comprises a bulk of filtration material 77 such as cellulose acetate having several grooves 78 extending along at least part of the length of and on a peripheral region of the filter insert unit 30. The filter insert unit 30 is wrapped using a plugwrap or other suitable wrapper. The wrapper may comprise perforations to allow a certain amount of smoke to pass therethrough, the perforations for instance coinciding with the grooves 78. The filter insert unit 30 may be provided with a second wrapper 79 which does not follow the contours of the peripheral grooves 78 so that channels are defined between the second wrapper and the bulk of the filtration material, as shown in FIG. 29B. In use, when the filter insert unit 30 of FIG. 29A is inserted into a recess 25, smoke may pass through the perforations in the plug wrap of the filter insert unit 30 providing a unique smoking experience. FIG. 29C shows a filter insert unit 30 according to an embodiment where no second wrapper 79 is used.

As an alternative to the embodiment shown in FIGS. 29A-C, the grooves may be provided as helical, peripheral grooves to provide a modified smoke delivery route.

Figure 30:
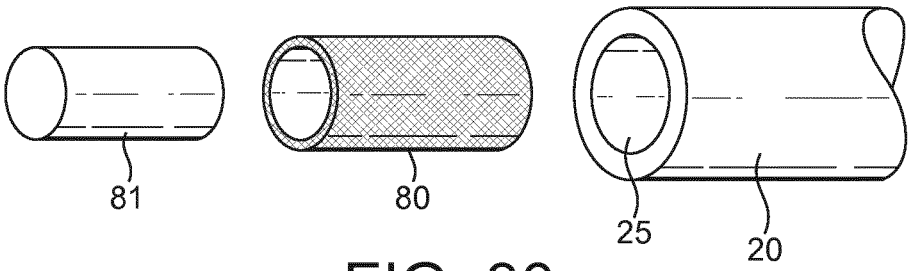
FIG. 30 is a side-on view of a filter and filter insert unit according to another embodiment.

FIG. 30 shows an embodiment where the filter insert unit 30 comprises a cylindrical part 80 and a tubular part 81. The cylindrical part 80 may be formed from filtration material such as cellulose acetate. The tubular part 81 may be formed from card although other materials may be used. The outer surface of the cylindrical part 80 and the inner and outer surfaces of the tubular part 81 may be provided with barbs so that the cylindrical part 80 may be retained within the tubular part 81 and so that the tubular part 81 may be retained within the recess 25 of a filter 20.

Figure 31A:
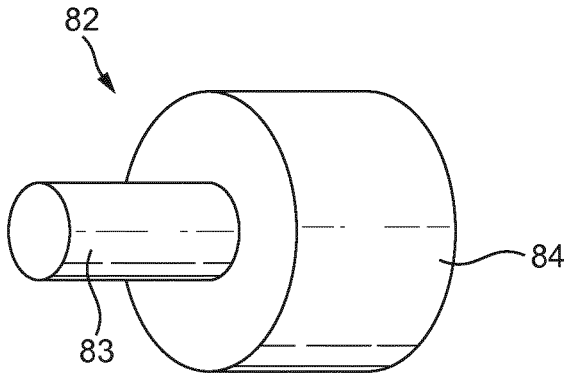
FIGS. 31A and 31B are side-on views of filter insert units according to further embodiments.

FIG. 31A shows another embodiment. A filter insert unit 82 comprises thin insertable part 83, arranged to be inserted into a recess 25, and a thicker non-insertable part 84. Both parts 83, 84 may be formed from any of the materials hereinbefore described.

Figure 31B:
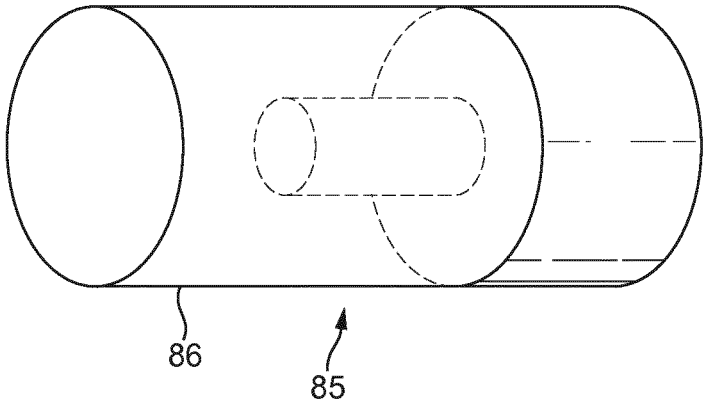

FIG. 31B shows a filter insert unit 85 similar to the a filter insert unit 82 shown in FIG. 31B except that the filter insert unit 85 further comprises a sleeve 86 arranged to fit over the outer surface of a filter 20. The sleeve 86 may be formed from any suitable material such as paper or card.

Figure 32:
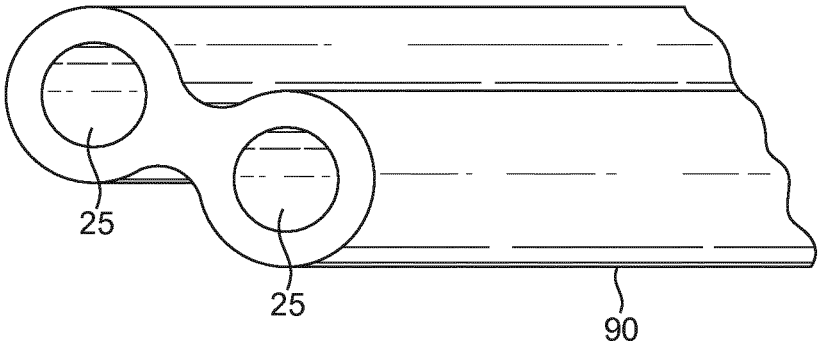
FIG. 32 is a three dimensional view of a filter according to an embodiment of the present invention.

FIG. 32 shows a filter 85 according to a further embodiment. The filter 90 comprises two recesses 25. Each recess 25 may have a filter insert unit 30 inserted therein. In alternative embodiments, more than two recesses may be provided. As used in the foregoing description, the term smoking article includes smokable products such as cigarettes, cigars and cigarillos whether based on tobacco, tobacco derivatives, expanded tobacco, reconstituted tobacco or tobacco substitutes and also heat-not-burn products.

The skilled person will understand from the foregoing detailed description that exemplary embodiments of the present invention provide:

An insertable filter unit for a smoking article filter, the filter unit comprising a retaining means to retain the insertable filter unit in the smoking article filter.

That the retaining means comprises a plurality of hooks disposed about a major surface of the insertable filter unit.

That the retaining means comprises a male locking member arranged to engage with a female locking member.

That the retaining means comprises a plurality of raised spots.

That the retaining means comprises a fluted region.

That the insertable filter unit is formed from a manually compressible material.

That the retaining means comprises an adhesive arranged to bond the insertable filter unit to a filter.

That the adhesive is applied to a major surface of the insertable filter unit.

That the adhesive is applied in at least one strip extending along the major surface of the insertable filter unit.

An adhesive containing capsule.

That the insertable filter unit has an end-on cross-sectional shape arranged to increase the surface area of the insertable filter unit.

That the insertable filter unit comprises a smoke modifying substance.

That the smoke modifying substance comprises an adsorbent material.

That the smoke modifying substance comprises a flavourant.

That the flavourant comprises at least one of: menthol, lemon, orange, lime, coffee and/or tea.

That the smoke modifying substance comprises a colourant.

That the smoke modifying substance comprises water.

That the smoke modifying substance is stored in a frangible capsule contained within the insertable filter unit.

That the smoke modifying substance is in thread form.

That the smoke modifying substance is in granule form.

An insertable filter unit for a smoking article filter, the insertable filter unit comprising a smoke modifying substance.

That the smoke modifying substance is stored in a frangible capsule contained within the insertable filter unit.

That the frangible capsule contains water.

That the smoke modifying substance is in granule form or in thread form.

That the smoke modifying substance comprises a carbon adsorbent.

That the smoke modifying substance comprises a colourant.

That the smoke modifying substance comprises a flavourant.

That the smoke modifying substance comprises at least one of: menthol, lemon, orange, lime, coffee and/or tea.

That the smoke modifying substance comprises water.

A smoking article filter comprising a recess for receiving an insertable filter unit. That the recess is at least partially circumscribed by a wall formed from filtration material.

That the recess is at least partially circumscribed by a wall formed from paper.

That the recess is at least partially circumscribed by a cardboard tube.

A smoking article filter comprising a recess having filter unit retaining means arranged therein.

That the smoking article filter comprises a female receiving member arranged to receive a male locking member of an insertable filter unit.

That the retaining means comprises a removable cap articulated about a point situated at a buccal end of the smoking article filter.

That the smoking article filter recess has a screw thread arranged therein.

That the retaining means comprises a gate arranged to open inwardly only.

That the retaining means comprises an adhesive applied to a major surface of the recess.

A kit of parts comprising an insertable filter unit and a smoking article filter.

A smoking article having an insertable filter unit inserted into the recess of the smoking article filter.

Embodiments of the invention are configured to comply with applicable laws and/or regulations, such as, by way of non-limiting example, regulations relating to flavours, additives, emissions, constituents, and/or the like. For example, the invention may be configured such that a smoking article implementing the invention is compliant with applicable regulations before and after use/manipulation by a user.

In order to address various issues and advance the art, the entirety of this disclosure shows by way of illustration various embodiments in which the claimed invention(s) may be practiced and provide for superior smoking article filters and insertable filter units. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An insertable filter unit for a heat-not-burn product, the filter unit comprising:

a modifying substance; and a mechanical retaining means to retain the insertable filter unit in the heat-not-burn product;

wherein the mechanical retaining means comprises a structure that retains beyond what may be achieved by ordinary frictional contact between two substantially flat surfaces in contact; and the insertable filter unit comprises tobacco.

2. The insertable filter unit according to claim 1, wherein the mechanical retaining means comprises at least one of a barb and a screw thread.

3. The insertable filter unit according to claim 1, wherein the insertable filter unit is an insertable spike.

4. The insertable filter unit according to claim 1, formed from a manually compressible material.

5. The insertable filter unit according to claim 1, wherein the retaining means comprises an adhesive.

6. The insertable filter unit according to claim 1, wherein the modifying substance is stored in a frangible capsule contained within the insertable filter unit.

7. The insertable filter unit according to claim 6, wherein the frangible capsule contains water.

8. The insertable filter unit according to claim 6, wherein the modifying substance is in at least one of granule form and thread form.

9. The insertable filter unit according to claim 6, wherein the modifying substance comprises a carbon adsorbent.

10. The insertable filter unit according to claim 9, wherein the carbon adsorbent has a monolithic structure.

11. The insertable filter unit according to claim 1, comprising a colorant.

12. The insertable filter unit according claim 1, wherein the modifying substance comprises at least one of a flavorant and water.

13. The insertable filter unit according to claim 12, wherein the flavorant comprises at least one of: menthol, lemon, orange, lime, coffee and tea.

* * * * *